US006007366A

United States Patent [19]

Torii et al.

[11] Patent Number: 6,007,366

[45] Date of Patent: Dec. 28, 1999

[54] METHOD OF INCORPORATION CRIMP-STYLE CONNECTOR ONTO A BOARD AND AN ASSOCIATED CRIMP-STYLE CONNECTOR

[75] Inventors: Chieko Torii; Yuji Hatagishi, both of Shizuoka, Japan

[73] Assignee: Yazaki Corporation, Tokyo, Japan

[21] Appl. No.: 09/100,884

[22] Filed: Jun. 22, 1998

[30] Foreign Application Priority Data

| | | | |
|---|---|---|---|
| Jun. 20, 1997 | [JP] | Japan | 9-164271 |
| Aug. 29, 1997 | [JP] | Japan | 9-234775 |
| Oct. 15, 1997 | [JP] | Japan | 9-282225 |

[51] Int. Cl.[6] ..... H01R 4/24

[52] U.S. Cl. ..... 439/397; 439/404

[58] Field of Search ..... 439/404, 399, 439/398, 397, 417; 29/843, 842, 861, 863–867, 751, 753

[56] References Cited

U.S. PATENT DOCUMENTS

| | | | |
|---|---|---|---|
| 4,494,813 | 1/1985 | Daley, Jr. et al. | 439/404 |
| 4,693,532 | 9/1987 | Colleran et al. | 439/405 |
| 5,073,126 | 12/1991 | Kikuchi et al. | 439/397 |

*Primary Examiner*—Michael L. Gellner
*Assistant Examiner*—Antoine Ngandjui
*Attorney, Agent, or Firm*—Sughrue, Mion, Zinn, Macpeak & Seas, PLLC

[57] ABSTRACT

A reliable method of incorporating a crimp-style connector onto a printed circuit board. Even when a relatively long wire having a large diameter is used, the connector housing can be easily attached to the board and there is no possibility that the board will be warped. The method of incorporating a crimp-style connector (20) onto a board (10) by which a connector housing (21) provided with an electrical wire is incorporated onto the board (10), includes the following steps: attaching the connector housing (21) to the board (10); crimp-connecting the electrical wire with a crimp-blade (33) of a crimp-terminal (30) accommodated in a terminal accommodating chamber (22) in the connector housing (21); and soldering a fixing portion of the crimp terminal (30), which protrudes onto a reverse side 10*b* of the board (10), to a contact point on the board (10). Due to the foregoing, it is possible to accurately and positively crimp-connect an electrical wire between a pair of crimp-blades (33), (33) of the crimp terminal (30). Therefore, connection of the electrical wire can be simplified and quality can be enhanced.

8 Claims, 7 Drawing Sheets

METHOD OF INCORPORATION CRIMP-STYLE CONNECTOR ONTO A BOARD AND AN ASSOCIATED CRIMP-STYLE CONNECTOR

BACKGROUND OF THE INVENTION

1. Field of the Invention

The present invention relates to a method of incorporating a crimp-style connector onto a board, as well as the associated crimp-style connector.

2. Related Art

When a crimp-style connector provided with an insulated electrical wire is secured to a printed board, it is common that the electrical wire is first attached to a connector housing, and then the connector housing is secured to the printed board. This procedure of securing the crimp-style connector to the printed board will be described in detail as follows.

A crimp terminal is provided in each of a plurality of terminal accommodating chambers formed in a connector housing of the crimp-style connector. A crimp blade associated with the crimp terminal receives the insulated electrical wire of the terminal to establish electrical contact therebetween. Then, the connector housing, in which the electrical wires are crimp-connected, is attached onto a printed board. A male tab, which constitutes a fixing portion of each crimp terminal, protrudes onto a reverse side of the printed board and is soldered onto a pattern on the printed board. In this case, the pattern on the printed board is used as a contact point of soldering and the connector housing is secured to the printed board.

However, problems may be encountered in the above conventional method of securing or incorporating the crimp-style connector to the board, which will be described as follows. According to the above conventional method, after the insulated electrical wire has been attached to the connector housing, the connector housing is secured to the printed board. Therefore, for example, when the insulated electrical wire is used for a vehicle and the wire is relatively long and large in diameter, it is difficult to secure the connector housing, to which the electrical wire has already been attached, to the printed board. Further, when the connector housing is long, there is a possibility that the printed board may be badly warped. Therefore, the electrical connection of the wire to the printed board is not reliable. Further, when the electrical wire is attached to the connector housing after the connector housing has been secured to the printed board, there is a tendency that cracks will occur in the soldered portion between the connector housing and the printed board.

SUMMARY OF THE INVENTION

The present invention has been accomplished to solve the above problems. It is an object of the present invention to provide a highly reliable method of securing a crimp-style connector to a printed board and also to provide a crimp-style connector used for this method. One characteristic of the invention is that even when a relatively long electrical wire having a large diameter is used, the connector housing can be easily attached onto the board. Further, warpage of the board is prevented.

The method of the present invention includes the following steps: attaching the connector housing onto the board; crimp-connecting the electrical wire with a crimp-blade of a crimp-terminal accommodated in a terminal accommodating chamber in the connector housing; and soldering a fixing portion of the crimp terminal, which protrudes onto a reverse side of the board, to a contact point on the board.

When this method is adopted, the connector housing can be easily attached onto the board even when the wire is relatively long and has a large diameter. In other words, the wire can be easily handled. As a result, connection of the electrical wire can be simplified and the quality of the connection can be enhanced.

According to another aspect of the invention a plurality of crimp blades of the crimp terminals, which are arranged zigzag, are respectively crimp-connected with the electrical wires. As a result, it is possible to prevent an expansion of the terminal accommodating chamber of the connector housing. Correspondingly, it is possible to prevent the connector housing from being warped in the case where the electrical wire is crimp-connected with a connecting blade of each connecting terminal.

According to another aspect of the invention, the board is fixed to a center of a relatively long connector housing by a fixing means after the connector housing has been attached onto the board.

When the above method is adopted, it is possible to prevent the board from being warped. Therefore, the reliability of connection is enhanced.

According to yet another method, the following steps are performed: attaching the connector housing onto the board; soldering a fixing portion of the crimp terminal accommodated in a terminal accommodating chamber of the connector housing, the fixing portion protruding onto a reverse side of the board, to a contact point on the board; inserting an inserting portion of a protective jig into a recess provided between a bottom of the connector housing opposing a terminal accommodating chamber, and a surface of the board; and removing the protective jig from the recess after the electrical wire has been crimp-connected with the crimp-blade of the crimp-terminal.

When the above method of incorporating the crimp-style connector onto the board is adopted, even if the electrical wire is connected with the terminal of the connector after the terminal has been soldered onto the board, a load of the connection is not directly applied to the board in the process of crimp-connecting the electrical wire. Due to the foregoing, it is possible to prevent the occurrence of warp on the board and no cracks are caused in the soldered portion. Therefore, the reliability is enhanced.

Further, since the recess is formed in the bottom surface of the connector housing, the weight of the entire crimp-style connector can be reduced.

Further, the heat generated in the process of soldering is seldom transmitted to the crimp-blade of the crimp-style terminal. Accordingly, there is no deterioration in the connection of the electrical wire to the crimp blade. Further, soldering work can be easily executed, and a soldered portion of the crimp-terminal on the board can be easily checked by the visual inspection from the surface side of the board.

As noted above, the recess in the connector is formed at a position on a bottom surface of the connector housing opposing to the terminal accommodating chamber.

When this crimp-style connector is used, the recess formed on the bottom surface of the connector housing functions as a radiating section from which heat is radiated when the fixing portion of the crimp-style terminal is soldered onto the board. Therefore, it is possible to provide a crimp-style connector of high quality, at a low cost.

DETAILED DESCRIPTION OF THE INVENTION

Referring to the accompanying drawings, embodiments of the present invention will be explained as follows.

FIGS. 1 to 4 are perspective views and schematic illustrations showing a process of incorporating the crimp-style connector onto the board, according to a first embodiment of the present invention.

Before explaining the method of incorporating the crimp-style connector onto the board of this embodiment, a brief explanations will be provided for the printed board (board) 10, crimp-style connector 20, crimp terminal 30, insulated electrical wire (electrical wire) 40 and crimp-connection jig 50.

Figure 1:
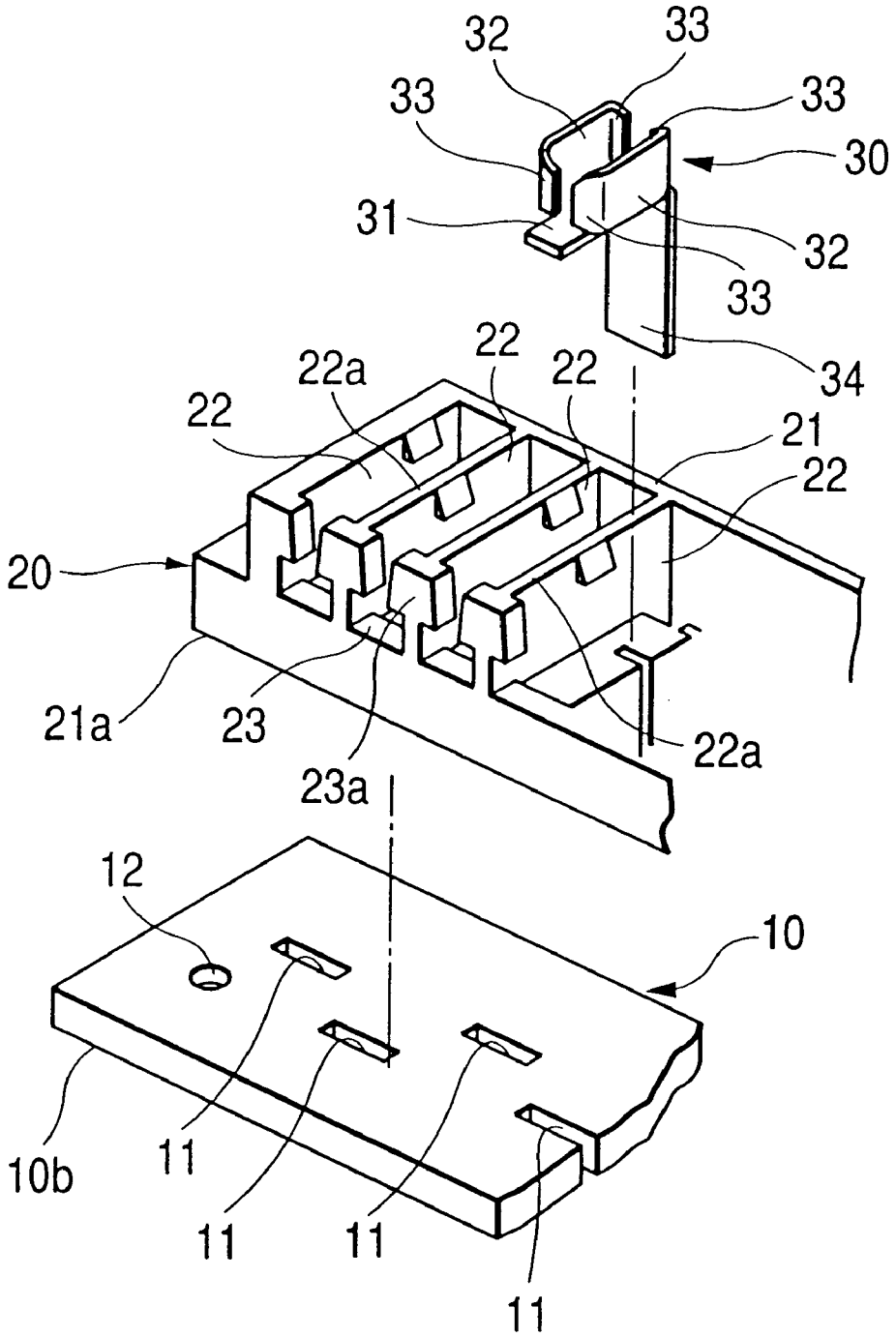
FIG. 1 is a partial perspective view showing a state immediately before the crimp-style connector is secured to the board in the first embodiment.

As shown in FIG. 1, the printed board 10 is has a generally rectangular shape and has a plurality of small rectangular terminal through-holes 11, which are arranged in a zigzag manner, and small circular positioning fixing holes (portion to be fixed) 12 formed therein. Conductive patterns (contact points) 13 are provided on the reverse side 10*b* of the printed board 10 around the through holes 11.

The connector housing 21 of the crimp-style connector 20 is made of synthetic resin and has a box-like shape. On the upper surface side of the connector housing 21, there are provided a plurality of terminal accommodating chambers 22 which are divided by partition walls 22*a*. At positions on the front wall side of the connector housing 21, opposing the terminal accommodating chambers 22, there are respectively provided electrical wire holding ports 23. The upper portion 23*a* of each electrical wire holding port 23 has a substantially V-shape (i.e., the upper portion being the widest and the lower side being relatively narrow). As a result, the covered electrical wire 40 can be easily inserted into an associated terminal accommodating chamber 22. On both sides of the bottom surface 21*a* of the connector housing 21, there is provided a circular (fixing means) 24, 24 which protrudes from the bottom surface 21*a*.

Figure 4:
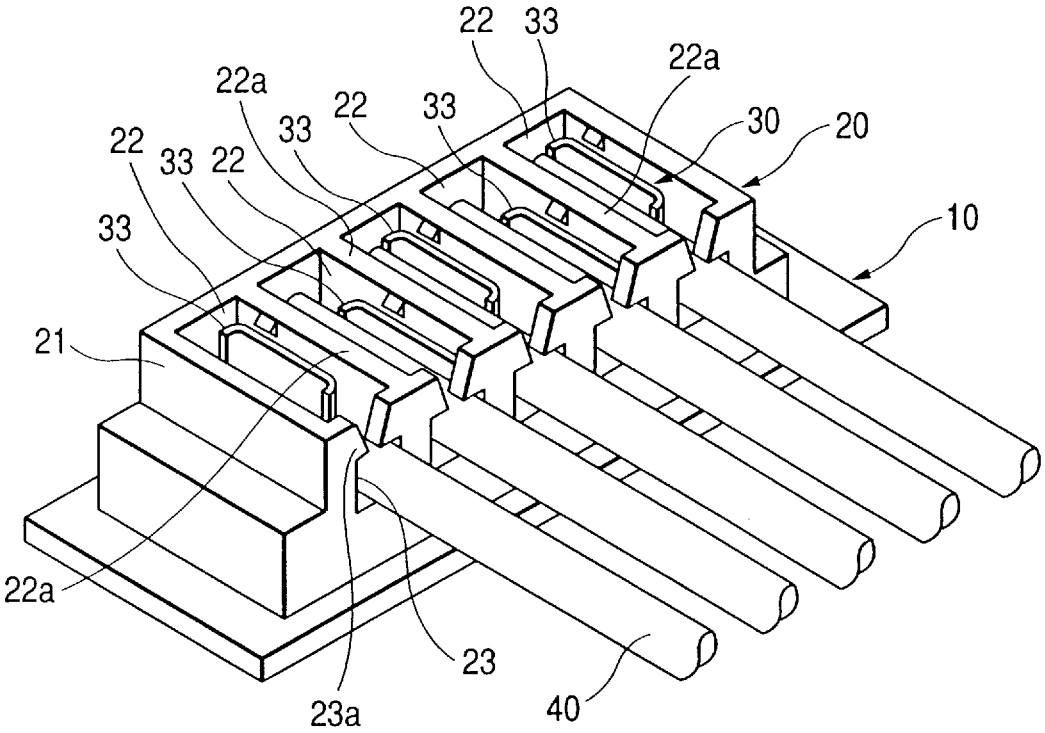
FIG. 4 is a perspective view showing a state in which the crimp-style connector has been secured to the board.

A crimp-style terminal 30 is provided in each terminal accommodating chamber 22 of the connector housing 21. The crimp-style terminal 30 includes a pair of side walls 32, 32 extending upwardly from both sides of the bottom plate 31 and a pair of crimp blades 33, 33 respectively located at the front and rear of the terminal. The rear end of the bottom plate 31 of each crimp terminal 30 is bent downwardly at a right angle so as to form a male tab portion (fixing portion) 34. Each crimp-style terminal 30 is integrated with the connector housing 21 by means of insertion molding, and the male tab 34 of each crimp-style terminal 30 penetrates the bottom of each terminal accommodating chamber 22 of the connector housing 21, so that the male tab 34 protrudes from the bottom surface 21*a* of the connector housing 21. As shown in FIG. 4, the terminals 30 are alternately positioned at the front and rear end of the terminal accommodating chambers 22 so as to be arranged in a zigzag manner in the lateral direction.

Figure 2:
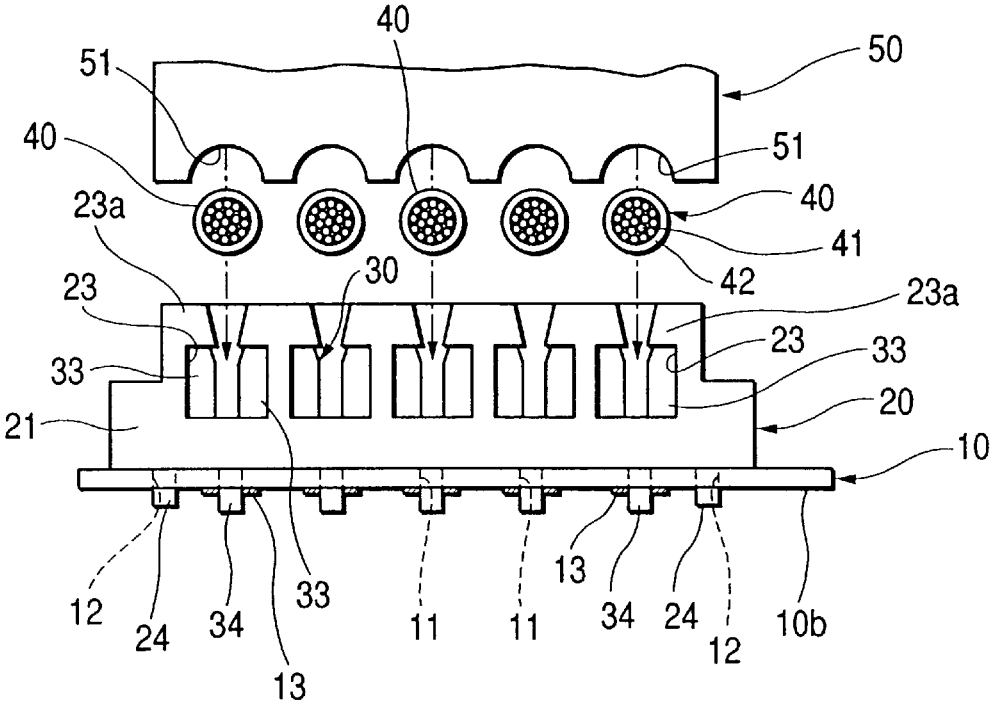
FIG. 2 is a schematic illustration showing a state immediately before the electrical wires are crimp-connected with the crimp terminals of the crimp-style connector after the crimp-style connector has been secured to the board.
Figure 3:
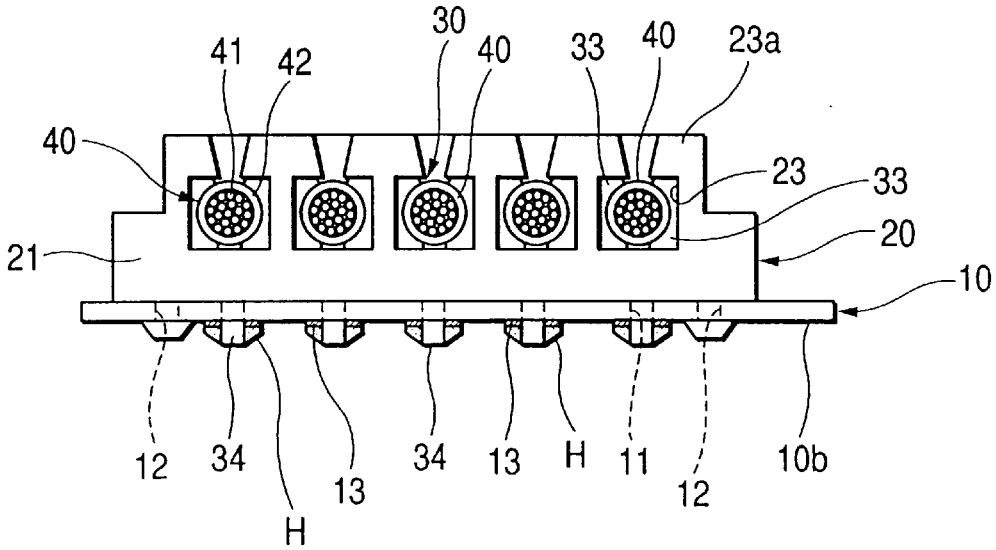
FIG. 3 is a schematic illustration showing a state in which the contact points on the board are soldered to the male tabs of the crimp terminals of the crimp-style connector.

As shown in FIGS. 2 and 3, the insulated electrical wire 40 includes an electrical wire conductor 41 and an insulating cover 42 which covers the electrical wire conductor 41. The crimp jig 50 is provided with a plurality of electrical wire pushing portions 51 having an arcuate shape. The wire pushing portions 51 are inserted between the front crimp blade 33 and the rear crimp blade 33.

Next, a method of incorporating the crimp-style connector 20 onto the printed board 10, in which the insulated electrical wires 40 and the crimp blades 50 are used, will be explained. First, as shown in FIGS. 1 and 2, the male tabs 34 of the crimp-style terminals 30 and the bosses 24, which protrude from the bottom surface 21*a* of the connector housing 21, are respectively inserted into the terminal through-holes 11 and the positioning fixing holes 12 formed on the printed board 10. Next, as shown in FIG. 2, each insulated electrical wire 40 is inserted between a pair of crimped blades 33, 33 of the crimp-style terminal 30 accommodated in each terminal accommodating chamber 22 of the connector housing 21. The crimp jig 50 is used for accomplishing this crimp-connection. As a result, the insulating cover 42 of the covered electrical wire 40 is torn by the crimp blades 33. As a result, the electrical wire conductor 41 of the covered electrical wire 40 is crimp-connected with each crimp blade 33, so that the crimp-style terminal 30 and the insulated electrical wire 40 are electrically connected with each other. Then, as shown in FIG. 3, the male tab 34 of each crimp-style terminal 30, which protrudes from the reverse side 10*b* of the printed board 10, is soldered to the pattern 13 provided on the printed board 10. This soldered portion is represented by reference mark H in FIG. 3. In the process of soldering, each boss 24 protruding from the bottom surface 21*a* of the connector housing 21 is melted by a predetermined melting means, so that the connector housing 21 and the printed board 10 are melted with each other. In this way, the crimp-style connector 20 is secured to the printed board 10 as shown in FIG. 4.

According to this method of securing the crimp-style connector 20 to the printed board 10, the connector housing 21 is attached to the printed board 10 before the covered electrical wires 40 are attached onto the connector housing 21. Therefore, the attaching work of the covered electrical wires 40 can be easily executed. Thus, even when relatively long wires with large diameters are attached to the crimp-style connector 20, the wires 40 can be crimp-connected with the crimp terminals 30 in the terminal accommodating chambers 22 of the connector housing 21 after the connector housing 21 has been attached to the printed board 10. Therefore, the long and thick electrical wires 40 can be easily handled, and one end portion of the electrical wire 40 can be accurately and positively crimp-connected with a pair of crimp blades 33, 33 of the crimp terminal 30. Due to the foregoing, connection of the electrical wires can be simplified and quality can be further enhanced. Concerning the crimp-style connector 20 secured to the printed board 10, it is unnecessary to form the connector into a male connector or a female connector. Accordingly, the structure of the connector can be simplified.

According to another aspect of the invention, the crimp blades 33 of the crimp terminals 30 are arranged zigzag in the terminal accommodating chambers 22 of the connector housing 21, and the covered electrical wire 40 is crimp-connected with each crimp blade 33. Due to the above structure, when the covered electrical wire 40 is crimp-connected with the crimp blade 33 of each crimp terminal 30, it is possible to prevent the partition wall 22*a* of each terminal accommodating chamber 22 of the connector housing 21 from expanding. Further, it is possible to positively prevent the entire connector housing 21 from warping. Due to the foregoing, the reliability of connection of the crimp-style connector 20 with the printed board 10 is enhanced.

Figure 5:
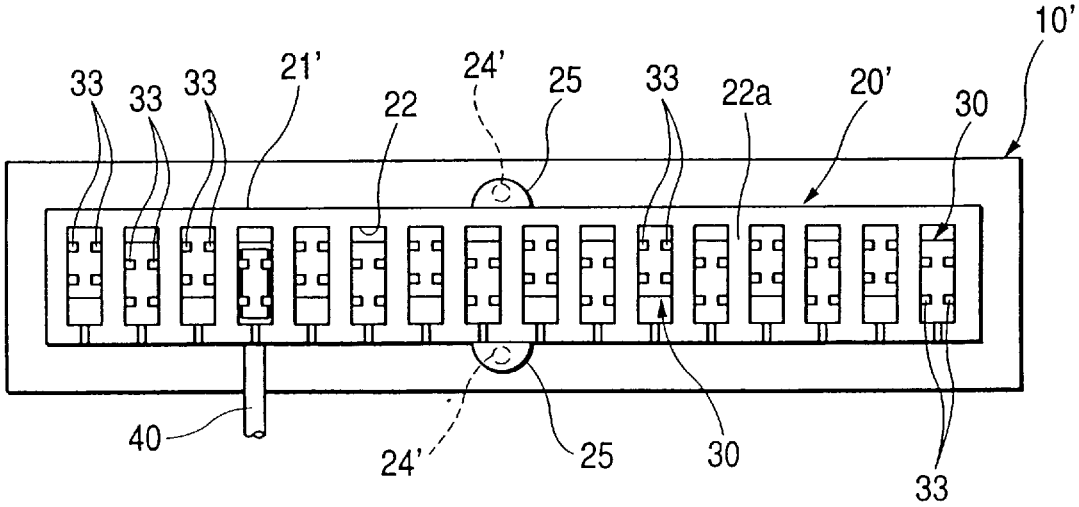
FIG. 5 is a plan view showing a state in which the crimp-style connector has been secured to the board in the second embodiment of the present invention.
Figure 6:
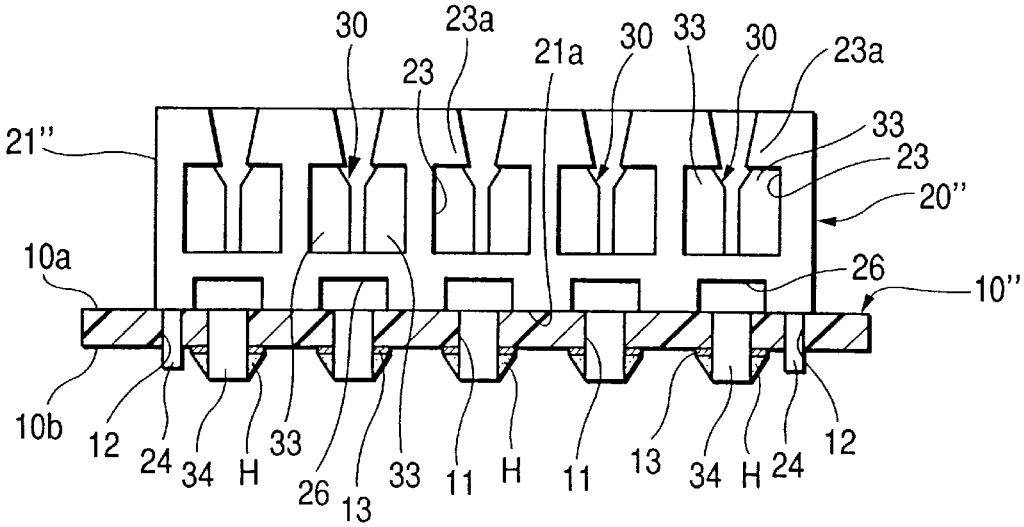
FIG. 6 is a schematic illustration showing a state in which the contact points on the board are soldered to the male tabs of the crimp terminals of the crimp-style connector after the crimp-style connector has been attached to the board in the third embodiment of the present invention.
Figure 7:
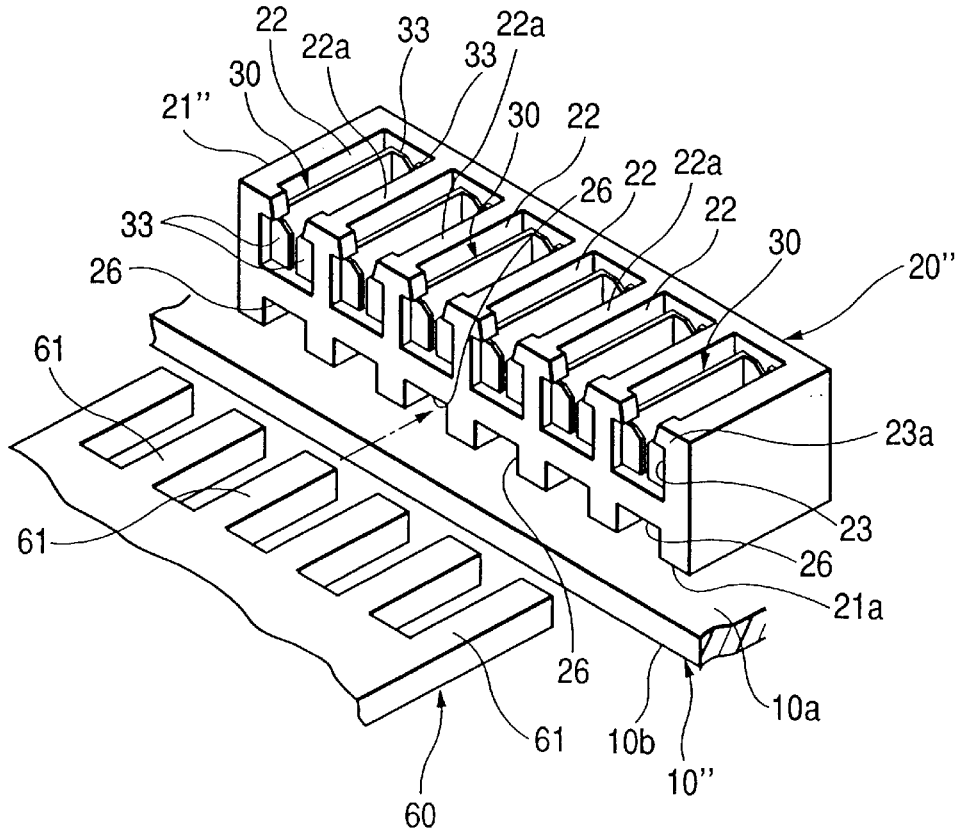
FIG. 7 is a perspective view showing a state immediately before the inserting section of the protective jig is inserted into between the board and the recess of the crimp-style connector in the third embodiment.
Figure 9:
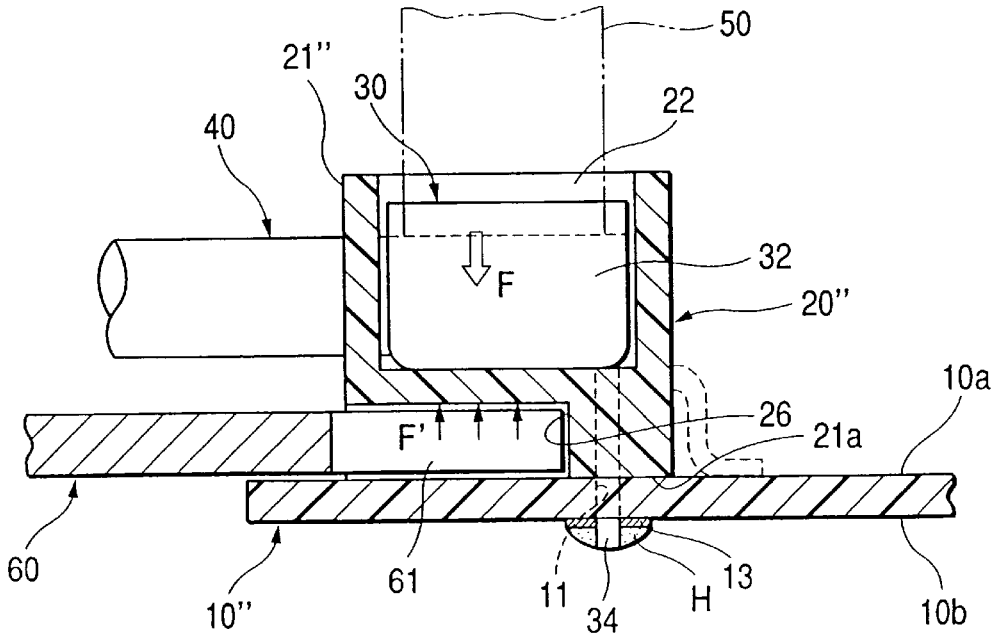
FIG. 9 is a cross-sectional view showing a state in which the electrical wires are crimp-connected with the crimp terminals of the crimp-style connector in the third embodiment.

FIG. 5 is a plan view showing a state in which the crimp-style connector has been secured to the board in the second embodiment of the present invention. The crimp-style connector 20' used in this method of incorporating the crimp-style connector onto the board is provided with a long connector housing 21'. In the terminal accommodating chambers 22 of this long connector housing 21', the crimp blades 33 of the crimp terminals 30 are arranged zigzag. In the process of soldering after the connector housing 21' has been attached to the long printed board 10', bosses 24' (fixing means) of the tong pieces 25 integrally protruding from the centers of the front and the rear wall of the long connector housing 21' are melted and connected with the connector housing 21' and the printed board 10' in the same manner as that of the above embodiment. Due to the foregoing, it is possible to prevent the printed board 10' and the long connector housing 21' from warping in the same manner as that of the above embodiment. Due to the foregoing, the reliability of connection of the connector housing 21' of the crimp-style connector 20' with the printed board 10' is enhanced. FIGS. 6, 7 and 9 are respectively a schematic illustration, perspective view and cross-sectional view for successively showing a process of incorporating the crimp-style connector onto the board according to the third embodiment of the present invention.

Before explaining the method of securing the crimp-style connector onto the board in this embodiment, brief explanations will be made for the printed board (board) 10", crimp-style connector 20", crimp terminal 30, covered electrical wire (electrical wire) 40, crimp-connection jig 50 and protective jig 60.

The printed board 10" is rectangular, on which a plurality of small rectangular terminal through-holes 11 and small circular positioning fixing holes (portion to be fixed) 12 are respectively formed. Conductive patterns (contact points) 13 are formed on the reverse side 10*b* of the printed board 10" around the through-holes 11. As shown in FIGS. 6 and 7, the connector housing 21" of the crimp-style connector 20" is made of synthetic resin and formed into a box-like shape. On the upper surface side of the connector housing 21", there are provided a plurality of terminal accommodating chambers 22 which are divided by the partition walls 22*a*. At positions on the front wall side of the connector housing 21" opposing to the terminal accommodating chambers 22, there are respectively provided electrical wire holding ports 23. The upper portion 23*a* of each electrical wire holding port 23 is cut out into a V-shape, as discussed above. Due to this shape, the covered electrical wire 40 can be easily urged into each terminal accommodating chamber 22. On both sides of the bottom surface 21*a* of the connector housing 21", there are provided a pair of circular bosses (fixing means) 24, 24 which integrally protrude from the bottom surface 21*a*. As shown in FIGS. 6 to 9, at positions on the bottom surface 21*a* of the connector housing 21" opposing to the terminal accommodating chambers 22, spaces are formed, which are rectangular parallelepiped recess portions 26, the front side and the bottom side of which are open.

Figure 8:
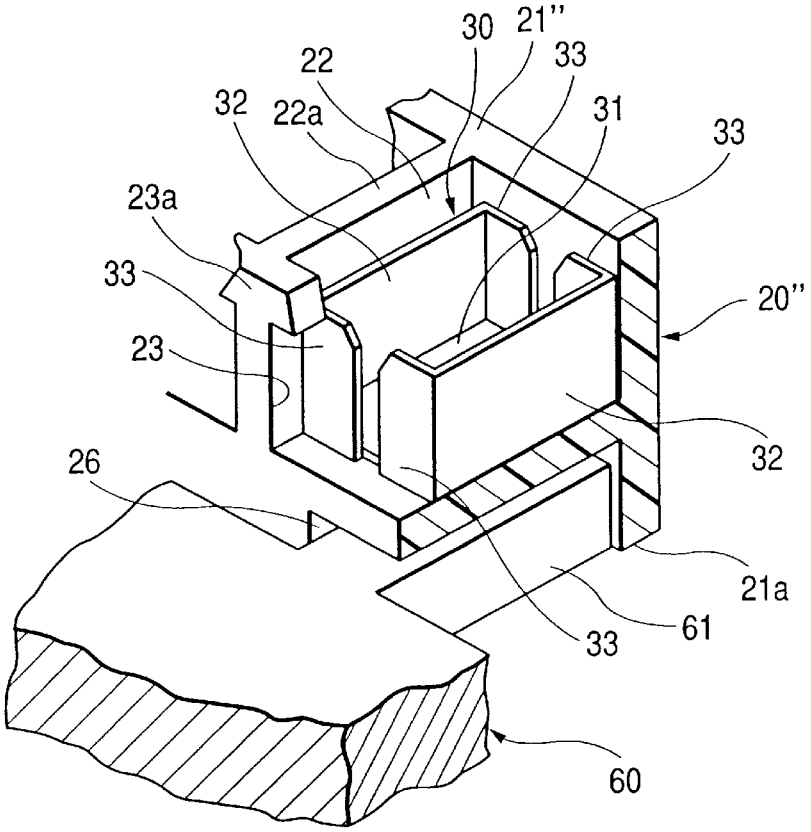
FIG. 8 is a partially enlarged perspective view showing a state in which the inserting section of the protective jig is inserted into the recess of the crimp-style connector of the third embodiment, wherein a cross-section of a portion is shown in the view.

As shown in FIG. 8, there is provided a crimp terminal 30 in each terminal accommodating chamber 22 of the connector housing 21". The crimp terminal 30 is composed of a pair of side walls 32, 32 which extend upwardly from both sides of the bottom plate 31. A pair of crimp blades 33, 33 are formed (by bending) in the front and at the rear of each side wall 32, 32. The rear end of the bottom plate 31 of each crimp-style terminal 30 is bent downward by at a right angle and formed into a male tab portion (fixing portion) 34. Each crimp-style terminal 30 is integrated with the connector housing 21" by means of insertion molding, and the male tab 34 of each crimp terminal 30 penetrates the bottom of each terminal accommodating chamber 22 of the connector housing 21", so that the male tab 34 protrudes from the bottom surface 21*a* of the connector housing 21".

The covered electrical wire 40 and the crimp jig 50 have the same structure as that of the embodiment described before. On the front side of a protective jig 60, there is provided an inserting section 61 which is inserted into each recess portion 26 of the connector housing 21". The inserting section 61 integrally protrudes in the form of a tooth.

Next, a method of incorporating the crimp-style connector 20" onto the printed board 10", in which the covered electrical wires 40 and the protective jig 60 are used, will be explained below. First, as shown in FIG. 6, the male tabs 34 of the crimp-style terminals 30 and the bosses 24, which protrude from the bottom surface 21*a* of the connector housing 21", are respectively inserted into the terminal through-holes 11 and the positioning fixing holes 12 formed in the printed board 10". The male tab 34 of each crimp-style terminal 30, protruding from the reverse side 10*b* of the printed board 10", is soldered to the pattern 13 provided on the printed board 10". This soldered portion is represented by reference mark H in FIGS. 6 and 9. In the process of soldering, each boss 24, protruding from the bottom surface

21*a* of the connector housing 21", is melted by a predetermined melting means, so that the connector housing 21" and the printed board 10" are melted with each other.

Next, as shown in FIGS. 7 and 8, each inserting section 61 of the protective jig 60 is inserted into each recess portion 26 provided between the bottom surface 31*a* of the connector housing 21" opposing to each terminal accommodating chamber 22, and the surface 10*a* of the board 10". Next, as shown in FIG. 9, each electrical wire 40 is crimp-connected by a pair of crimp blades 33, 33 of the crimp-style terminal 30 accommodated in each terminal accommodating chamber 22 of the connector housing 21". In this case, a press load (crimp load) F is applied to a pair of crimp blades 33, 33 of the crimp terminal 30 by the crimp jig 50. However, since a resilience F" for the press load F acts on each inserting portion 61 of the protective jig 60, crimp connection is conducted on the covered electrical wire 40 while the press load F is not directly applied to the printed board 10". Due to the foregoing, there is no possibility that the printed board 10" will be warped when the covered electrical wire 40 is crimp-connected. Also, there is no possibility that cracks will be formed in the soldered portion H. After the covered electrical wire 40 has been crimp-connected with each crimp blade 33 of the crimp terminal 30, each inserting section 61 of the protective jig 60 is removed from each recess portion 26 of the connector housing 21". In this way, the securing of the crimp-style connector 20" to the printed board 10" is completed.

According to this method of securing the crimp-style connector 20" to the printed board 10", the connector housing 21" is attached to the printed board 10" before the covered electrical wires 40 are attached to the connector housing 21". Therefore, the attaching work of the covered electrical wires 40 can be easily executed. Even when long wires having a large diameter are attached to the crimp-style connector 20", the long and thick covered electrical wire 40 can be crimp-connected with the crimp terminal 30 in each terminal accommodating chamber 22 of the connector housing 21" after the connector housing 21" has been attached and soldered onto the printed board 10". Therefore, the long and thick covered electrical wires 40 can be easily handled, and one end portion of the wire 40 can be accurately and positively crimp-connected with a pair of crimp blades 33, 33 of the crimp terminal 30. Due to the foregoing, connection of the electrical wires can be simplified and the quality can be further enhanced. It is noted that there are provided a plurality of recess portions 26 on the bottom surface 21*a* of the crimp-style connector 20". Accordingly, the weight of the entire connector can be reduced because the recess portions 26 are formed.

Figure 10:
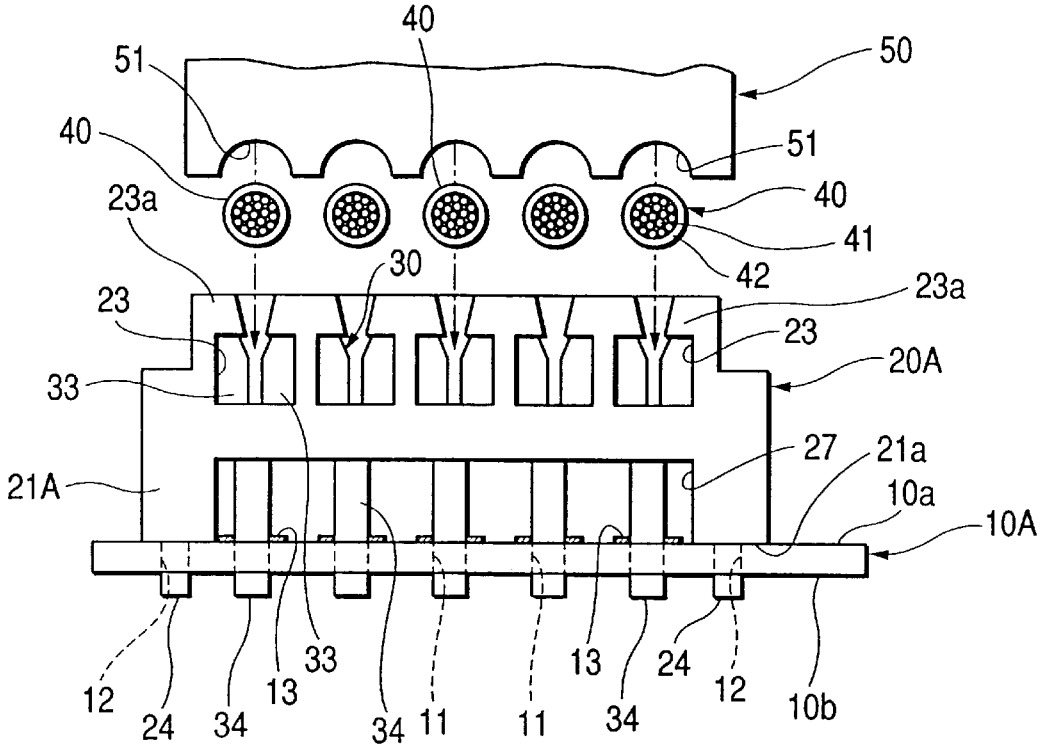
FIG. 10 is a schematic illustration showing a state immediately before the electrical wires are crimp-connected with the crimp terminals of the crimp-style connector after the crimp-style connector has been secured to the board in the fourth embodiment.
Figure 11:
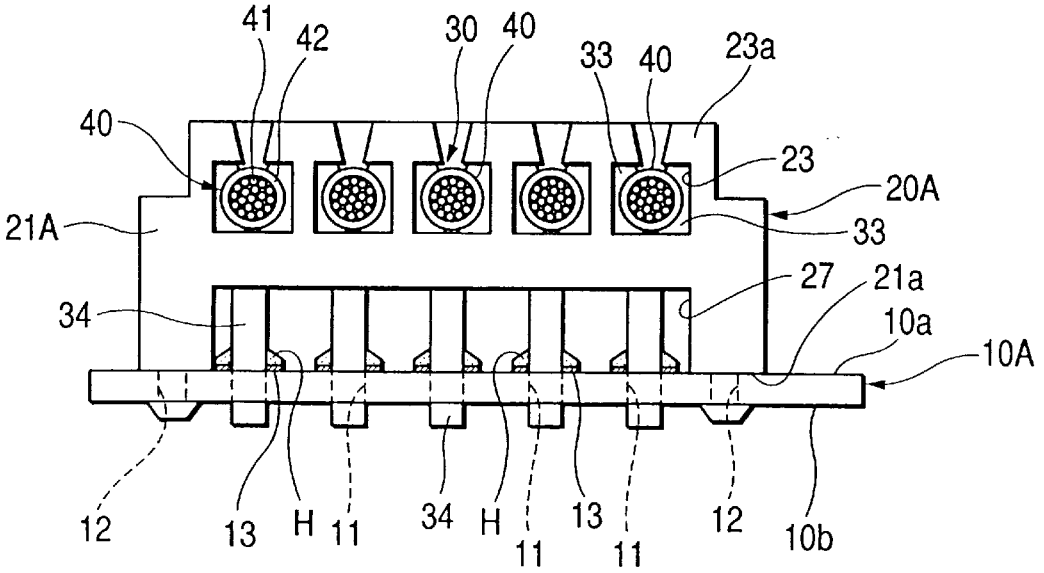
FIG. 11 is a schematic illustration showing a state in which the contact points on the board are soldered to the male tabs of the crimp terminals of the crimp-style connector in the fourth embodiment.
Figure 12:
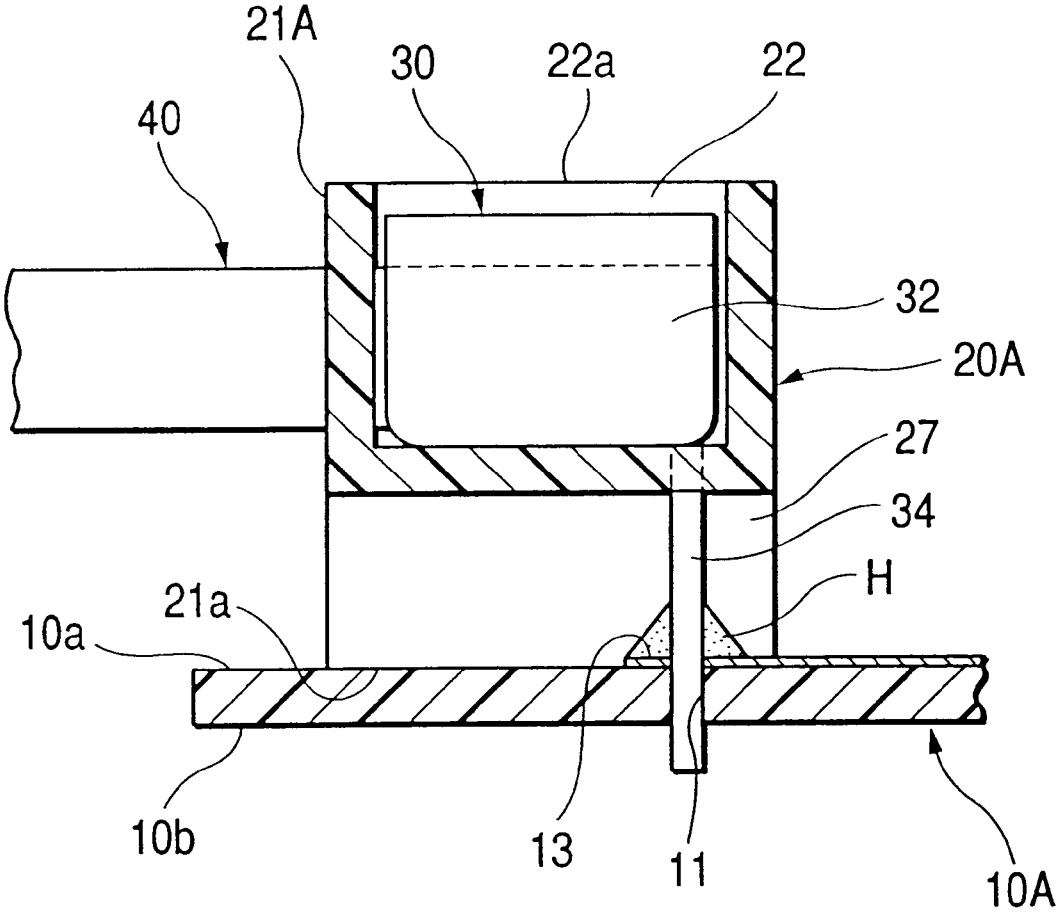
FIG. 12 is an enlarged cross-sectional view showing a state in which the contact points on the board are soldered to the male tabs of the crimp terminals of the crimp-style connector in the fourth embodiment.

FIG. 10 is a schematic illustration showing a state immediately before the electrical wires are crimp-connected with the crimp terminals of the crimp-style connector after the crimp-style connector has been incorporated onto the board in the fourth embodiment of the present invention. FIG. 11 is a schematic illustration showing a state in which the contact points on the board are soldered to the male tab portions of the crimp terminals of the crimp-style connector. FIG. 12 is an enlarged cross-sectional view showing a state of soldering.

The crimp-style connector 20A used for the method of incorporating the crimp-style connector onto the board in this fourth embodiment is composed as follows. At positions on the bottom surface 21*a* of the connector housing 21A corresponding to a plurality of terminal accommodating chambers 22, there is a recess 27 (or recesses), used for radiation, through which the male tabs (fixing portions) 34 of the crimp terminals 30 accommodated in the terminal accommodating chambers 22 are exposed onto the surface 10*a* side of the printed board 10A. This recess 27 extends in the longitudinal direction. Conductive patterns (contact points) 13 are provided on the surface 10*a* on the printed board around the terminal through-holes 11. Other features of the structure are the same as those of the printed board 10 and the crimp-style connector 20 used for the first embodiment. Therefore, like reference characters are used to indicate like parts in this embodiment, and the detailed explanations are omitted here.

As shown in FIG. 10, when the crimp-style connector 20A is secured to the printed board 10A, the connector housing 21A is attached to the printed board 10A, and then the covered electrical wires 40 are crimp-connected with the pairs of crimp blades 33, 33 of the crimp terminals 30 accommodated in the terminal accommodating chambers 22 of the connector housing 21A. Next, as shown in FIGS. 11 and 12, the male tabs 34 exposed onto the bottom surface 21*a* side of the connector housing 21A of the crimp terminal 30 are soldered to the surface 10*a* of the printed board 10A.

Due to the foregoing, the same action and effect as that of the first embodiment described before can be provided by this embodiment. In this embodiment, only the recess 27 used for radiation in the case of soldering is formed on the bottom surface 21*a* of the connector housing 21A. Therefore, it is possible to provide a crimp-style connector 20A of high quality having a high electrical wire crimp-connecting performance at low cost. When this crimp-style connector 20A is used, heat is seldom transmitted to the crimp-blades 33 of the crimp terminals 30 in the process of soldering. Accordingly, the electrical wire crimp-connecting performance of the crimp blades 33 is not deteriorated, and the electrical wires are connected in a good condition. Further, this embodiment is advantageous in that the soldering work can be easily executed and that the soldered portions H, at which the male tabs 34 of the crimp terminals 30 are connected with the printed board 10A, can be easily checked from the surface 10*a* side of the printed board 10A.

In this connection, in the embodiments described above, the fixing means for fixing the printed board to the crimp-style connector is composed of bosses and fixing holes with which the bosses are engaged. However, it should be noted that the fixing means is not limited to the bosses and the fixing holes; that is, a fixing means comprised of screws may be used for fixing the printed board to the crimp-style connector.

We claim:

1. A method of securing a crimp-style connector to a board by which a connector housing provided with an electrical wire is incorporated onto the board, comprising the following steps:

attaching the connector housing to a top surface of the board;

soldering a fixing portion of the crimp terminal accommodated in a terminal accommodating chamber of the connector housing to a contact point on the bottom surface of the board, the fixing portion protruding to the bottom surface of the board;

inserting an inserting portion of a protective jig into a recess provided between a bottom wall of the connector housing opposing the terminal accommodating chamber, and a the top surface of the board;

crimp-connecting the electrical wire with a crimp-blade of a crimp-terminal accommodated in a terminal accommodating chamber in the connector housing; and removing the protective jig from the recess after the electrical wire has been crimp-connected with the crimp-blade of the crimp-terminal.

2. A crimp-style connector arrangement, comprising:

a connector housing having a plurality of terminal accommodating chambers, said connector housing being attachable to a front side of a printed board;

a plurality of crimp-terminals respectively provided in said terminal accommodating chambers, said crimp-terminals each including a fixing portion extending therefrom, said fixing portion extending to a rear side of said printed board to be soldered to a pattern on said rear side, wherein said connector housing includes a plurality of recesses respectively corresponding to said terminal accommodating chambers, said recesses being provided between a bottom wall of said connector housing and said printed board in alignment with said terminal accommodating chambers; and a jig including a plurality of jig teeth that are respectively insertable into said plurality of recesses for supporting said housing when electrical wires are crimp-connected with said plurality of crimp-terminals.

3. The crimp-style connector of claim 2, wherein said plurality of crimp-terminals are arranged in a zigzag manner.

4. The crimp-style connector of claim 3, wherein adjacent ones of said crimp-terminals are offset from each other in a longitudinal direction of said connector housing.

5. A method of securing a crimp-style connector to a board by which a connector housing provided with an electrical wire is incorporated onto the board, comprising the following steps:

attaching the connector housing onto a top surface of the board;

crimp-connecting the electrical wire with a crimp-blade of a crimp-terminal accommodated in a terminal accommodating chamber in the connector housing; and soldering a fixing portion of the crimp terminal, which is exposed onto a bottom surface of the connector housing, to a contact point on said top surface of the board.

6. A crimp-style connector, comprising:

a connector housing having a plurality of terminal accommodating chambers, said connector housing being attachable to a front side of a printed board; and a plurality of crimp-terminals respectively provided in said terminal accommodating chambers, said crimp-terminals each including a fixing portion extending therefrom, said fixing portion extending to a rear side of said printed board, wherein said connector housing includes a recess between a bottom wall of said connector housing and said printed board and in alignment with said terminal accommodating chambers, said recess providing access to said front side of said printed board in the area of each said fixing portion to allow soldering of each said fixing portion to said front side of said printed board.

7. The crimp-style connector of claim 6, wherein said plurality of crimp-terminals are arranged in a zigzag manner.

8. The crimp-style connector of claim 7, wherein adjacent ones of said crimp-terminals are offset from each other in a longitudinal direction of said connector housing.

* * * * *